US008656718B2

(12) United States Patent
Takeshita et al.

(10) Patent No.: US 8,656,718 B2
(45) Date of Patent: Feb. 25, 2014

(54) STEAM SYSTEM, CONTROL SYSTEM THEREOF AND CONTROL METHOD THEREOF

(75) Inventors: Kazuko Takeshita, Hiroshima-ken (JP); Susumu Kouno, Hiroshima-ken (JP); Haruaki Hirayama, Hiroshima-ken (JP); Naohiko Ishibashi, Hiroshima-ken (JP); Yosuke Nakagawa, Hiroshima-ken (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 850 days.

(21) Appl. No.: 12/375,780

(22) PCT Filed: Feb. 14, 2008

(86) PCT No.: PCT/JP2008/052457
§ 371 (c)(1),
(2), (4) Date: Jul. 2, 2009

(87) PCT Pub. No.: WO2008/099894
PCT Pub. Date: Aug. 21, 2008

(65) Prior Publication Data

US 2009/0288414 A1 Nov. 26, 2009

(30) Foreign Application Priority Data

Feb. 16, 2007 (JP) ..... 2007-036825

(51) Int. Cl.
*F01K 13/02* (2006.01)

(52) U.S. Cl.
USPC ..... 60/646; 60/657; 60/663; 60/666

(58) Field of Classification Search
USPC ..... 60/646, 657, 660, 661, 663, 666
See application file for complete search history.

(56) References Cited

U.S. PATENT DOCUMENTS 3,894,394 A * 7/1975 Braytenbah et al. ..... 376/211
3,990,244 A 11/1976 Kruger et al.

(Continued)

FOREIGN PATENT DOCUMENTS

JP 50-127003 B 10/1975
JP 56-159601 A 11/1981

(Continued)

OTHER PUBLICATIONS

Weiss G et al: "Weiterentwicklung Der Regel- Und Sicherheits-systeme Fuer Dampfturbinen" VGB Kraftwerkstechnik, VGB Kraftwerkstechnik GMBH, ESSEN, DE, vol. 73, No. 4, Apr. 1, 1993, pp. 345-351, XP000358566.

(Continued)

*Primary Examiner* — Hoang M Nguyen
(74) *Attorney, Agent, or Firm* — Westerman, Hattori, Daniels & Adrian, LLP

(57) ABSTRACT

In a steam system having a turbine driven by steam supplied from a high-pressure header to a low-pressure header, when the pressure in the low-pressure header drops, a turbine bypass valve is opened and the high-pressure side steam is supplied to the low-pressure side header in a normal control. When the turbine is tripped, steam is rapidly flow into the low-pressure side header and its pressure temporally increases. the steam in the low-pressure header is discharged through a discharge valve. After that, if a steam supply from the low-pressure header to another process increases, the discharge valve is closed. After the discharge valve is fully closed, an after-trip control is performed in which the opening of the turbine bypass valve is increased at an earlier timing than the normal control for preventing the steam amount in the low-pressure header to be too small. The control stability of the steam system when the turbine is tripped can be enhanced.

15 Claims, 4 Drawing Sheets

(56) References Cited

U.S. PATENT DOCUMENTS

| | | | | |
|---|---|---|---|---|
| 4,007,595 | A | 2/1977 | Braytenbah et al. | |
| 4,007,596 | A * | 2/1977 | Braytenbah et al. | 376/211 |
| 4,330,367 | A | 5/1982 | Musick | |
| 4,455,614 | A * | 6/1984 | Martz et al. | 700/288 |
| 4,679,399 | A * | 7/1987 | Strickler | 60/646 |
| 4,752,697 | A | 6/1988 | Lyons et al. | |
| 4,975,238 | A | 12/1990 | Regan et al. | |
| 5,133,189 | A | 7/1992 | Hurley | |
| 7,997,084 | B2 | 8/2011 | Kamohara et al. | |
| 2005/0198939 | A1 | 9/2005 | Hattori et al. | |
| 2006/0101824 | A1 | 5/2006 | Takeda et al. | |

FOREIGN PATENT DOCUMENTS

| | | | |
|---|---|---|---|
| JP | 58-005415 | A | 1/1983 |
| JP | 63-071505 | A | 3/1988 |
| JP | 63-243406 | A | 10/1988 |
| JP | 7-229405 | A | 8/1995 |
| JP | 11-257018 | A | 9/1999 |

OTHER PUBLICATIONS

European Search Report dated Mar. 8, 2010, issued in European Patent Application No. 08711296.

International Search Report of PCT/JP2008/052457, Mailing Date of May 13, 2008.

Written Opinion of International Searching Authority dated Feb. 14, 2008, for International application No. PCT/JP2008/052457.

European Search Report dated Mar. 8, 2010, issued in corresponding European Patent Application No. 08711297.5.

International Search Report of PCT/JP2008/052458 dated of mailing May 13, 2008.

US Office Action dated Jan. 15, 2013, issued in corresponding U.S. Appl. No. 12/376,375.

U.S. Notice of Allowance dated Aug. 22, 2013, issued in related U.S. Appl. No. 12/376,375 (19 pages).

* cited by examiner

STEAM SYSTEM, CONTROL SYSTEM THEREOF AND CONTROL METHOD THEREOF

TECHNICAL FIELD

The present invention relates to a control of a steam system. This application is based on Japanese Patent Application No. 2007-036825 filed on Feb. 16, 2007. Disclosure of the Japanese Patent Application is incorporated hereby by reference.

BACKGROUND ART

In chemical plants such as a methanol plant and an ammonia plant (a urea plant is included), high-temperature and high-pressure steam is used. FIG. 1 shows an example of a steam system for controlling the steam.

The steam system 2 has a high-pressure header 4 which stores high-pressure steam therein and a low-pressure header 6 which stores low-pressure steam whose pressure is lower than that of the high-pressure steam. In some plants, a header corresponding to the low-pressure header 6 in FIG. 1 may be referred to as a medium-pressure header.

The high-pressure header 4 is connected to a waste-heat boiler 8. The waste-heat boiler 8 supplies high-pressure steam to the high-pressure header 4. A supply system of the waste-heat boiler 8 has a safety valve 10 and a discharge valve 12. When a steam pressure of the supply system exceeds a first predetermined pressure, a controller of a discharge valve 12 gradually increases valve opening set to be fully closed in normal time to release steam to the outside of the system. When pressure of the supply system exceeds a second predetermined pressure set larger than the first predetermined pressure, the safety valve 10 is opened depending on the steam pressure to release steam to the outside of the system. The high-pressure header 4 is further connected to an auxiliary boiler 14. The auxiliary boiler 14 supplies high-pressure steam generated by the auxiliary boiler (package boiler) to the high-pressure header 4. Pressure of the steam supplied by the waste-heat boiler 8 is higher than pressure of the steam supplied by the auxiliary boiler 14.

The low-pressure header 6 has a discharge valve 30. When steam pressure in the low-pressure header 6 exceeds a predetermined discharge valve control start pressure, a controller 32 of the discharge valve 30 gradually increases the valve opening set to be fully closed in normal time to release steam to the outside of the system. This control is performed by means of a PI controller using a difference between a measurement value PV of the steam pressure in the low-pressure header 6 and a discharge valve MV set to be slightly larger than a target value of the steam pressure in the low-pressure header in normal time. A pressure set value of the controller 32 of the discharge valve 30 is larger than a pressure set value of a low-pressure side controller 27 of a turbine bypass valve 23 described later.

The low-pressure header 6 further has a safety valve 28. When a steam pressure exceeds a safety valve control start pressure set to be larger than the discharge valve control start pressure, the safety valve 28 is opened depending on the steam pressure to release steam to the outside of the system. The low-pressure header 6 further supplies low-pressure steam to another process 34.

The high-pressure header 4 is connected to a turbine 16. High-pressure steam in the high-pressure header 4 is introduced into the turbine 16 through a turbine inlet piping 18. The turbine 16 is driven by the high-pressure steam, supplies mechanical energy to external apparatuses not shown and discharges steam with lower pressure. A part of the discharged steam is supplied to the low-pressure header 6 through a turbine outlet piping 20. Another part of the steam is supplied to a condenser not shown and the like.

The steam system 2 further has a turbine bypass line 22 connecting the high-pressure header 4 to the low-pressure header 6. The turbine bypass line 22 has the turbine bypass valve 23 for controlling a flow of steam flowing therein. When the turbine bypass valve 23 is opened, high-pressure steam in the high-pressure header 4 bypasses the turbine 16 and is supplied to the low-pressure header 6 through the turbine bypass line 22.

The turbine bypass valve 23 is controlled by operating a solenoid according to a control signal sent from a control part 24. The control part 24 has a high-pressure side controller 25, a low-pressure side controller 27 and a higher-order selector 26.

The high-pressure side controller 25 receives an input of a high-pressure side pressure being a plant value obtained by measuring pressure of the high-pressure steam in the high-pressure header 4. Based on a pre-stored process, the high-pressure side controller 25 generates high-pressure side MV for instructing opening of the turbine bypass valve 23 from the input high-pressure side pressure and outputs the high-pressure side MV. The high-pressure side MV is generated, for example, according to a PI control based on the difference between the high-pressure side pressure and the high-pressure side pressure set value. The pressure set value of the high-pressure side controller 25 is smaller than the pressure of the steam supplied by the waste-heat boiler 8 and is larger than the pressure of the steam supplied by an auxiliary boiler 13.

The low-pressure side controller 27 receives an input of low-pressure side pressure being a plant value obtained by measuring pressure of the low-pressure steam in the low-pressure header 6. Based on a pre-stored process, the low-pressure side controller 27 generates the low-pressure side MV for instructing the opening of the turbine bypass valve 23 from the input low-pressure side pressure. The low-pressure side MV is generated, for example, according to a PI control based on the difference between the low-pressure side pressure and the low-pressure side pressure set value.

The higher-order selector 26 receives inputs of the high-pressure side MV and the low-pressure side MV, selects the larger value of them as MV for control, controls the turbine bypass valve 23 and sends steam of controlled amount from the high-pressure header 4 to the low-pressure header 6. According to such control, when steam pressure in the high-pressure header 4 becomes higher than a predetermined level, the steam pressure in the high-pressure header 4 can be decreased. Furthermore, when steam pressure in the low-pressure header 6 becomes lower than a predetermined level, the steam pressure in the low-pressure header 6 can be increased.

The low-pressure header 6 is further connected to a low-pressure steam supply system not shown. The low-pressure steam supply system supplies low-pressure steam to the low-pressure header 6. The low-pressure steam supply system is controlled by a control device which previously stores a low-pressure side flow control SV therein. When pressure in the low-pressure header 6 exceeds the low-pressure side flow control SV, the amount of steam supplied from the low-pressure steam supply system to the low-pressure header 6 is decreased.

Japanese Laid-Open Patent Application JP-A-Heisei, 11-257018 describes an invention on a steam turbine steam bypass device for smoothly releasing steam used on a turbine side to a high-pressure steam condenser when a steam turbine is shut down in an emergency due to break-down (at trip).

Japanese Laid-Open Patent Application JP-A-Heisei, 7-229405 describes a turbine bypass control method in a combined plant including: a turbine bypass having a turbine bypass valve connected to an inlet of a steam turbine; and a turbine governor for controlling the turbine bypass valve, wherein, when the turbine governor stops an automatic control of the turbine bypass valve, the turbine governor controls the turbine bypass valve using a pressure which is higher than the steam pressure at this time by a predetermined value as a setting pressure.

DISCLOSURE OF INVENTION

The inventors of this application found that instability in control as described below could occur in the above-mentioned steam system. The turbine 16 may be tripped during a period when the steam system 2 is operated. In the state where the turbine 16 is tripped, the amount of steam consumed by another process 34 may be increased and steam flow F5 supplied from the low-pressure header 6 to another process 34 may be increased.

When the turbine 16 is tripped, the bypass valve is rapidly opened by the above-mentioned control, and temporarily, pressure in the high-pressure header 4 is rapidly decreased and pressure in the low-pressure header is rapidly increased. After that, since steam is discharged from the discharge valve 30 to the outside, the pressure in the low-pressure header 6 lowers to 52 KG (kg/cm$^2$G) or less once and gradually increases toward 52 KG. Since the control part 24 decreases the opening of the turbine bypass valve 23, the pressure in the high-pressure header 4 gradually comes close to 107 KG.

FIGS. 2A to 2D show shift of a state of the plant after the above-mentioned state. In FIG. 2D, it is assumed that, before time t10, the steam flow F5 supplied to another process 34 is smaller than the steam flow F1 supplied from the waste-heat boiler 8 to the high-pressure header 1. At time t10, the steam flow F5 starts to increase.

Since the waste-heat boiler 8 generates steam by utilizing waste heat of an external system, the steam flow F1 supplied from the waste-heat boiler 8 to the high-pressure header 4 is substantially determined depending on conditions of the external system and cannot be flexibly controlled. As a result, at trip of the turbine, a steam flow F3 supplied from the high-pressure header 4 to the low-pressure header 6 does not increase and the steam flow F5 increases.

Accordingly, after time t10, the steam pressure in the low-pressure header 6 tends to decrease. Since the difference between the PV value and the SV value becomes large, the controller 32 of the discharge valve 30 generates a MV value as to decreases the opening of the discharge valve 30. Thus, the opening of the discharge valve 30 is gradually decreased and the decrease of the steam pressure in the low-pressure header 6 is suppressed.

At time t11, the discharge valve 30 is fully closed. As shown in FIG. 2C, after time t11, the steam pressure in the low-pressure header 6 lowers from the SV value of 52 KG of the controller 32. At time t12, the steam pressure represents the SV value of 48.5 KG of the low-pressure side controller 27 of control part 24 and is further reduced.

After time t12, the low-pressure side controller 27 generates an MV value as to increase the opening of the turbine bypass valve 23 and sends the MV value to the higher-order selector 26. As shown in FIG. 2A, however, at this time, the pressure in the high-pressure header 4 is high (107 KG). For this reason, the high-pressure side controller 24 generates the MV value so as to decrease the opening of the turbine bypass valve 23 and sends the MV value to the higher-order selector 26. For some time after time t11, the higher-order selector 26 selects the MV value of the high-pressure side controller 24 and uses the selected MV value to control the turbine bypass valve 23. The opening of the turbine bypass valve 23 is decreased and the pressure in the low-pressure header 6 is further decreased. The pressure in the low-pressure header 6 is abnormally decreased. This phenomenon is not preferred in terms of stability of operation of the steam system 2.

When the pressure in the low-pressure header 6 decreases beyond a certain extent, the MV value of the low-pressure side controller 27 becomes large and the higher-order selector 26 selects the MV value of the low-pressure side controller 27 as a control signal. The opening of the turbine bypass valve 23 decreases before this time, but increases after this time. As shown in FIG. 2D, the steam flow F3 of the turbine bypass line 22 increases and the steam pressure in the low-pressure header 6 also increases. However, since the steam pressure abnormally decreases once, relatively large hunting can occur.

When the steam flow F3 becomes large, the steam pressure in the high-pressure header 4 decreases. At time t13, when the steam pressure falls below the SV value of 105 KG of the controller 15 of the auxiliary boiler 13, as shown in FIG. 2B, a flow F2 of the steam supplied from the auxiliary boiler 13 to the high-pressure header 4 increases.

However, the auxiliary boiler 13 may have no readiness for offsetting the variation in pressure in the high-pressure header 4. In this case, as shown in FIG. 2A, there is possibility that the pressure in the high-pressure header 4 abnormally decreases. In addition, relatively large hunting can occur by the time when the pressure in the high-pressure header 4 returns to a normal state.

Such instability can occur at times other than at trip of the turbine. In a state where the steam pressure in the low-pressure header 6 is controlled by the opening of the discharge valve 30, when the steam flow F5 supplied to another process 34 increases, the steam pressure in the low-pressure header 6 decreases. In such case, if pressure drop does not stop even when the discharge valve 30 is fully closed, the turbine bypass valve 23 is opened and steam is supplied to the low-pressure header 6 according to a control of the opening. Also in this case, the unstable behavior can occur as in the above-mentioned trip of the turbine.

Then, an object of the present invention is to enhance stability of control of the steam system at trip of the turbine.

A steam system according to the present invention includes: a high-pressure header configured to store high-pressure steam; a turbine configured to be driven by the high-pressure steam supplied from the high-pressure header; a low-pressure header configured to store steam discharged from the turbine as low-pressure steam; a discharge valve configured to discharge the low-pressure steam to outside of the low-pressure header; a discharge valve controller configured to control an opening of the discharge valve such that a pressure of the low-pressure steam decreases when a pressure of the low-pressure steam is larger than a discharge valve pressure set value; a bypass configured to introduce steam from the high-pressure header to the low-pressure header by bypassing the turbine; a bypass valve configured to control steam flow in the bypass; a bypass valve controller configured to perform a normal control in which an opening of the bypass valve is controlled based on a plant value of a pressure of the low-pressure steam when the turbine is driven; and a trip time control section configured to perform a trip time control in which steam is supplied from the high-pressure header to the low-pressure header by bypassing the turbine in response to a trip signal indicating that the turbine trips. The bypass valve controller performs an after-trip control in which an opening of the bypass valve is controlled to be larger than in the normal control after the trip time control and when the turbine is tripped.

In a steam system according to the present invention, the bypass valve controller starts the after-trip control when an opening of the discharge valve becomes lower than a predetermined value.

In a steam system according to the present invention, the bypass valve controller starts the after-trip control when a steam pressure in the low-pressure header decreases more than a predetermined value relative to the discharge valve pressure set value.

In a steam system according to the present invention, the bypass valve controller includes a low-pressure side bypass valve controller configured to generate a low-pressure side control value for controlling the bypass valve such that a plant value of a pressure of the low-pressure steam approaches to a low-pressure side pressure set value.

In a steam system according to the present invention, the low-pressure side bypass valve controller generates the low-pressure side control value based on a difference between a plant value of a pressure of the low-pressure steam and the low-pressure side pressure set value.

In a steam system according to the present invention, the low-pressure side pressure set value is smaller than the discharge valve pressure set value.

In a steam system according to the present invention, the bypass valve controller further includes: a high-pressure side bypass valve controller configured to generate a high-pressure side control value for controlling the bypass valve such that a pressure of the high-pressure steam approaches to a high-pressure side pressure set value; and a selector configured to select a larger value among the low-pressure side control value and the high-pressure side control value as a control value for controlling an opening of the bypass valve in the normal control.

A steam system according to the present invention further includes: a waste-heat boiler configured to supply steam of a first pressure to the high-pressure header; and an auxiliary boiler configured to supply steam of a second pressure smaller than the first pressure. The high-pressure side pressure set value is smaller than the first pressure and larger than the second pressure.

In a steam system according to the present invention, the bypass valve controller sets the low-pressure side pressure set value to a trip time low-pressure side pressure set value being larger than the low-pressure side pressure set value in the normal control when the after-trip control is started.

In a steam system according to the present invention, the trip time low-pressure side pressure set value is set to a plant value of the low-pressure steam when the after-trip control is started.

In a steam system according to the present invention, the trip time low-pressure side pressure set value is set back to the low-pressure side pressure set value in the normal control at a predetermined change rate subsequent to a time when the after-trip control is started.

In the steam system according to the present invention, the after-trip control is started at timing when a pressure of the low-pressure steam becomes lower than the trip time low-pressure side pressure set value.

In a steam system according to the present invention, the after-trip control is performed by adding a surplus value gradually increasing to an opening instruction value of the bypass valve in the normal control.

According to the present invention, stability of control of the steam system at trip of the turbine is enhanced.

BEST MODE FOR CARRYING OUT THE INVENTION

Figure 1:
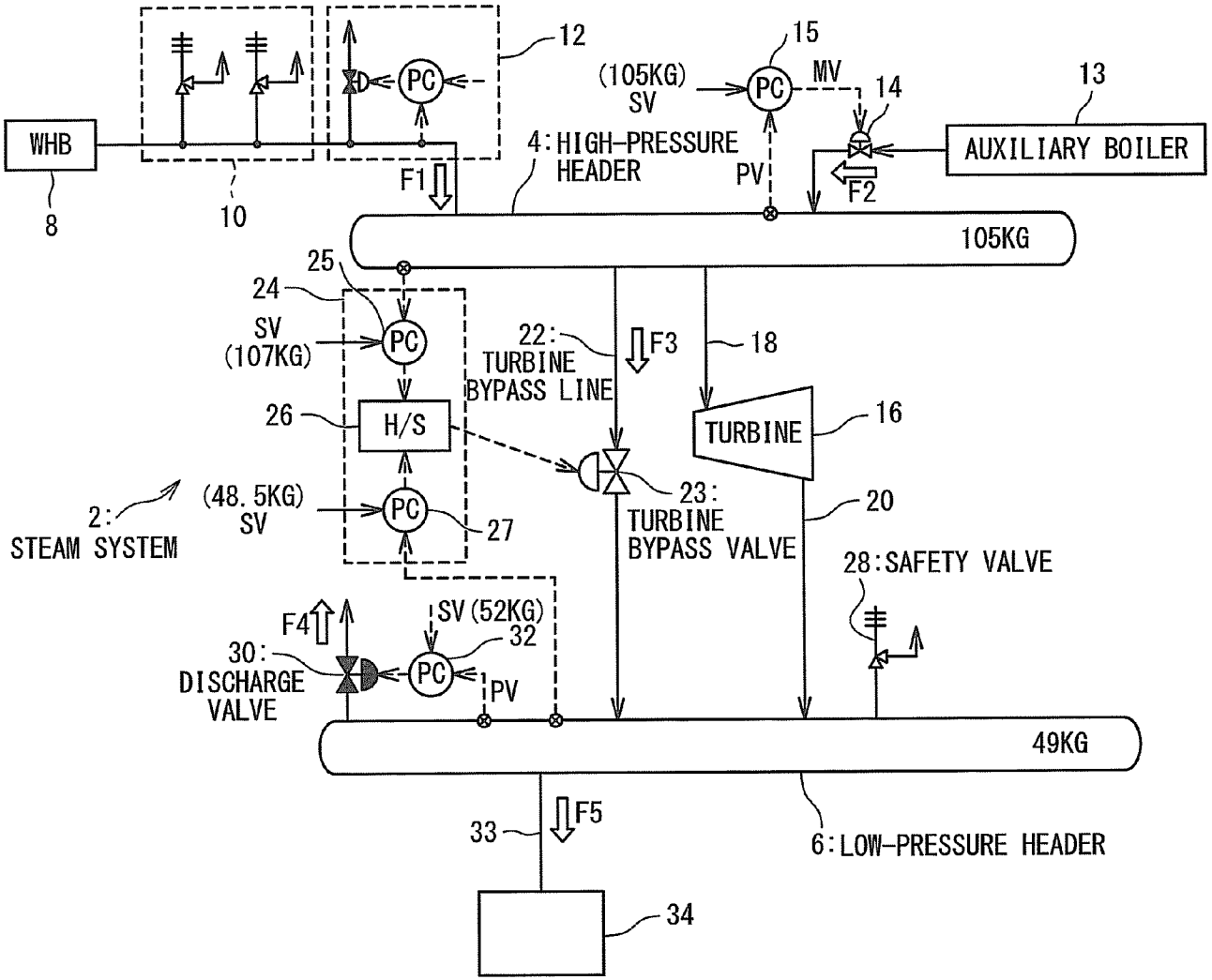
FIG. 1 shows a configuration of a steam system.

Best modes for carrying out the present invention will be described referring to the accompanying drawings. A control device and a control method in the present embodiment are realized by adding functions for trip of a turbine to the controller 32 of the discharge valve 30 and the control part 24 in the steam system 2 described referring to FIG. 1. Hereinafter, the function added to the controller 32 will be described referring to FIG. 1. The control in a normal operation is the same as that described above and thus description thereof is omitted.

Figure 2A:
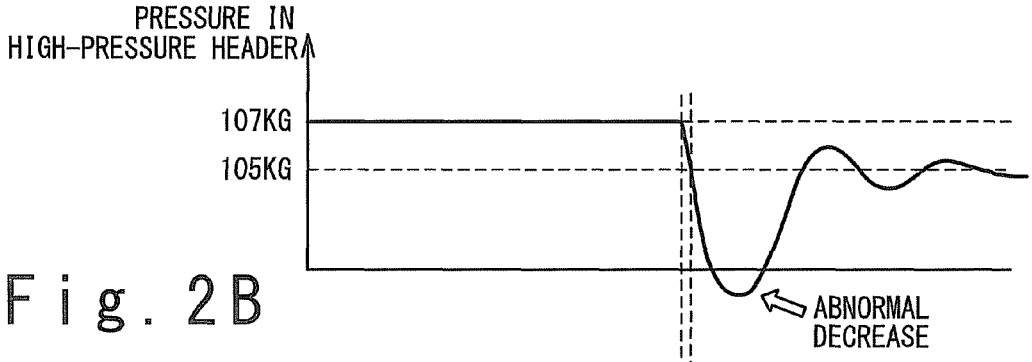
FIGS. 2A to 2D show shift in a state of a plant after trip of a turbine.
Figure 2B:
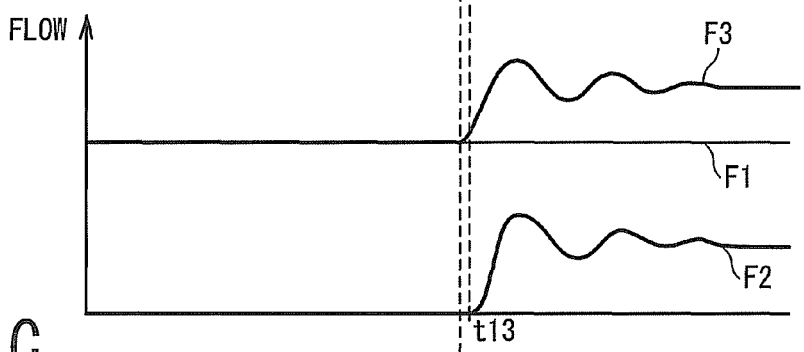
Figure 2C:
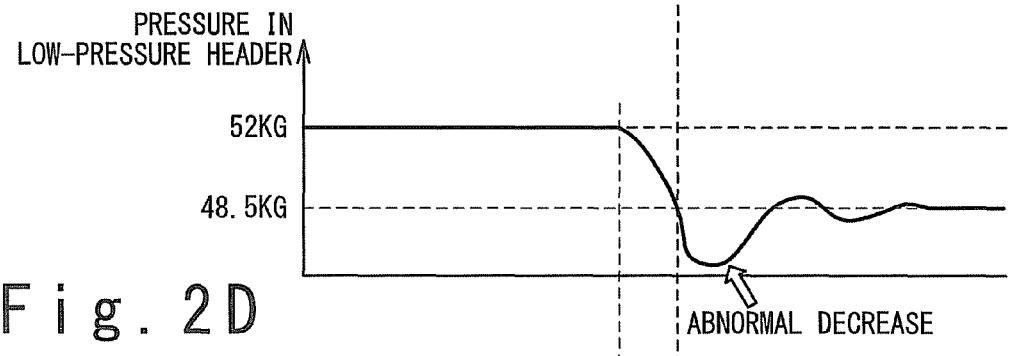
Figure 2D:
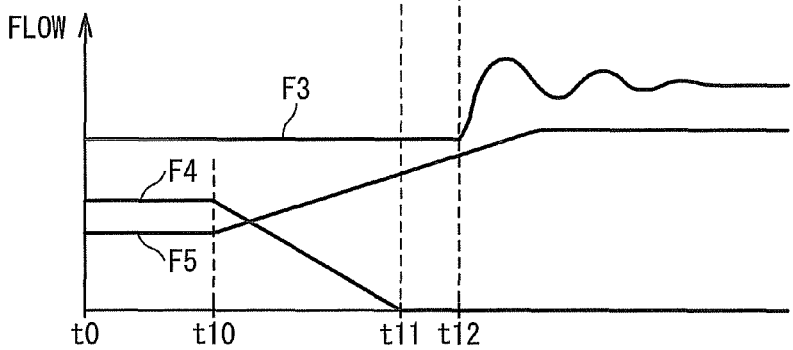
Figures 3A, 3B, 3C:
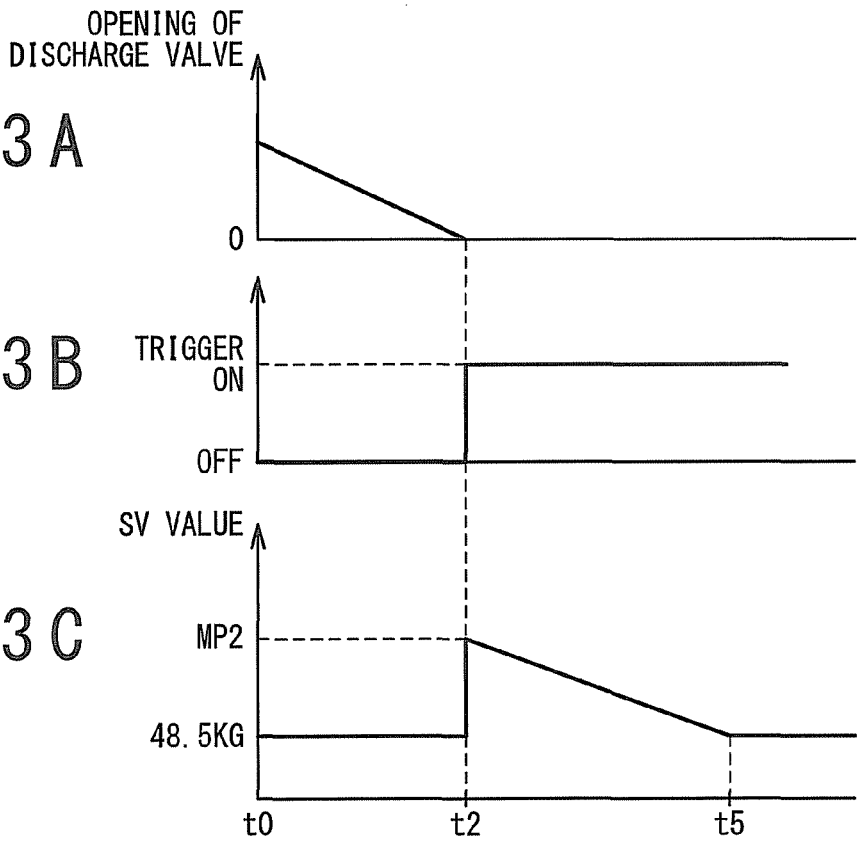
FIGS. 3A to 3C show operations of a controller after trip of the turbine.

Referring to FIGS. 3A to 3C, an operation of the controller 32 after trip of the turbine will be described. As shown in FIG. 3A, opening of a discharge valve is gradually decreased and at time t2, the discharge valve is fully closed. The time corresponds to time t11 in FIG. 2D. At this time, the controller 32 generates a trigger indicating that the discharge valve 30 is fully closed and sends the trigger to the control part 24. Depending on conditions of the plant, the trigger may be generated when the opening of the discharge valve 30 represents a predetermined value or less.

When the control part 24 receives the trigger at time t2, an after-trip control is started. The low-pressure side controller 27 is set to a manual operation and a set value is automatically set to a trip time low-pressure side pressure set value which is larger than the value in the normal control. Specifically, the control part 24 sets the SV value of the low-pressure side controller 27 to a plant value (MP2 in FIG. 3C) of the steam pressure in the low-pressure header 6 at that time. After time t2, the control part 24 lowers the SV value of the low-pressure side controller 27 at a predetermined change rate to the SV value of 48.5 KG in the normal control at time t5.

Next, a course of events in a state of the steam system subjected to the above-mentioned control after trip of the turbine will be described. When the turbine 16 is tripped, the bypass valve is rapidly opened according to the above-mentioned control, the pressure in the high-pressure header 4 rapidly decreases temporarily, and the pressure in the low-pressure header rapidly increases. After that, by opening the discharge valve 30, the pressure in the low-pressure header 6 decreases to 52 KG or less once and then, gradually increases toward 52 KG. Since the control part 24 controls to decrease the opening of the turbine bypass valve 23, the pressure in the high-pressure header 4 gradually comes close to 107 KG.

FIGS. 4A to 4D show a course of events in a state of the plant following this state. As described with regard to time t10 in FIG. 3D, the steam flow F5 starts to increase at time t1. Due to drop of the steam pressure along with the increase, the controller 32 decreases the opening of the discharge valve 30 and the steam flow F4 gradually decreases. At time t2, the discharge valve 30 is fully closed.

Figure 4A:
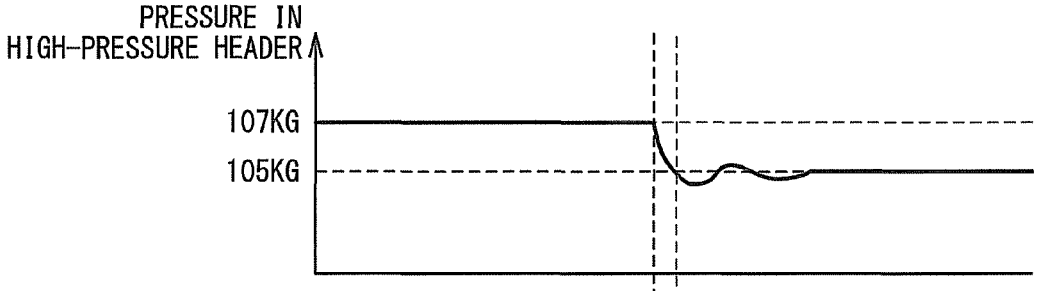
FIGS. 4A to 4D show shift in a state of the plant after trip of the turbine.
Figure 4B:
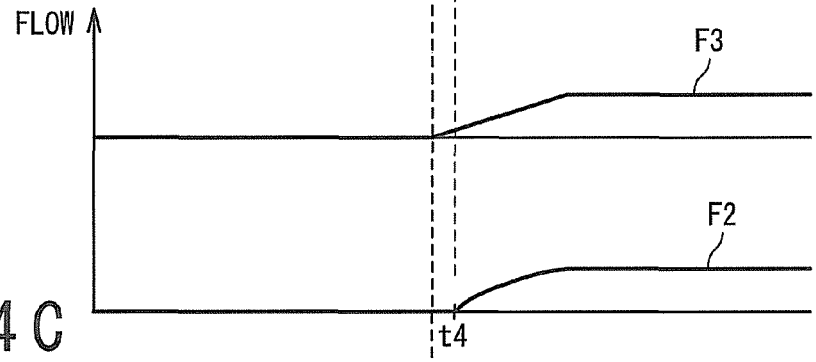
Figure 4C:
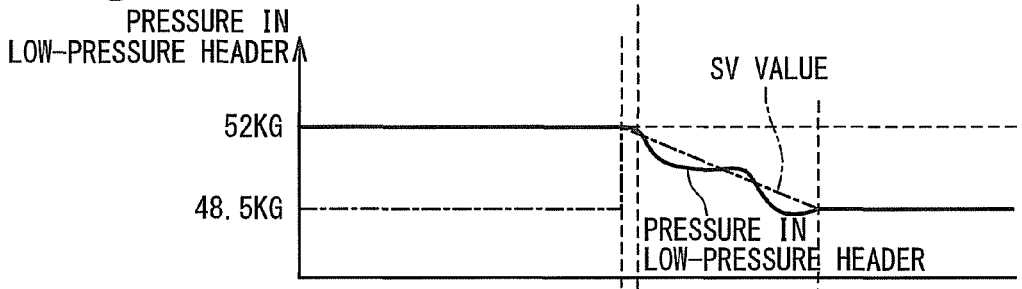
Figure 4D:
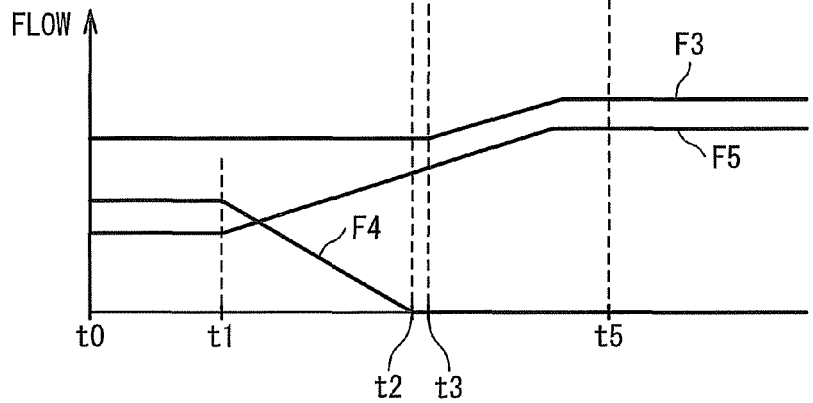

Referring to FIG. 4C, when the discharge valve 30 is fully closed at time t2, the trigger is turned ON and the SV value of the low-pressure side controller 27 is set from 48.5 KG in the normal control to the steam pressure in the low-pressure header 6 at time t2 (52 KG in FIG. 4C). This SV value (trip time low-pressure side pressure set value) decreases to the SV value in the normal control at a predetermined change rate.

Since the trip pressure set value is larger than the SV value in the normal control, after time t2, the steam pressure in the low-pressure header 6 falls below the trip time low-pressure side pressure set value in a short period of time. FIGS. 4A to 4D show the time as t3. After time t3, the low-pressure side controller 27 generates an opening instruction MV value so as to increase the opening of the turbine bypass valve 23. According to this control, the control part 24 performs control so as to increase the opening of the turbine bypass valve 23 in a short period of time after the discharge valve 30 is closed.

As a result, steam is quickly supplied to the low-pressure header 6 and as shown in FIG. 3C, the abnormal drop of the steam pressure in the low-pressure header 6 is avoided. Since the trip time low-pressure side pressure set value is gradually returned to the SV value in the normal control, hunting can be suppressed.

After time t3, the steam pressure in the high-pressure header 4 decreases. At time t4, the steam pressure in the high-pressure header 4 falls below the SV value of the controller 15 of the auxiliary boiler system. Then, the controller 15 increases opening of the auxiliary boiler steam flow control valve 14 and thus, the steam flow F2 increases. According to this control, steam of the auxiliary boiler 13 is supplied to the high-pressure header 4 in a short period of time after the discharge valve 30 is fully closed. As a result, as shown in FIG. 4A, the abnormal drop of the steam pressure in the high-pressure header 4 is avoided. Furthermore, hunting of the steam pressure is also suppressed. For this reason, as shown in FIG. 4B, the steam flow F3 of the turbine bypass line 22 smoothly increases in a short period of time after the discharge valve 30 is fully closed.

As described above, in the present embodiment, when the discharge valve 30 is fully closed and the pressure in the low-pressure header 6 cannot be controlled by the discharge valve 30, a low-pressure side set value of the turbine bypass valve 23 is set to be larger one. For this setting, since additional steam is supplied to the low-pressure header 6 before the steam pressure in the low-pressure header 6 substantially decreases, the abnormal drop of the steam pressure is avoided. As a result, stability of control after trip of the turbine is enhanced.

In the present embodiment, using full closure of the discharge valve 30 as the trigger, the after-trip control is started. In place of such control, the controller 32 of the discharge valve 30 performs control to generate the trigger at timing when the steam pressure in the low-pressure header 6 decreases relative to the SV value (52 KG) of the controller 32 by a predetermined width, thereby achieving a similar effect.

By adopting means other than the present embodiment, as to control after generation of the trigger, it is also possible to increase the steam flow F3 of the turbine bypass line 22. For example, by adding an adder which adds a surplus value gradually increasing in a ramp manner to an opening instruction value output by the selector 26 during a predetermined period subsequent to an occurrence of the trigger and controlling the turbine bypass valve 23 according to the output of the adder, the steam flow F3 can be increased to achieve the same effect as in the present embodiment.

The invention claimed is:

1. A steam system comprising:

a high-pressure header configured to store high-pressure steam;

a turbine configured to be driven by the high-pressure steam supplied from the high-pressure header;

a low-pressure header configured to store steam discharged from the turbine as low-pressure steam;

a discharge valve configured to discharge the low-pressure steam to outside of the low-pressure header;

a discharge valve controller configured to control an opening of the discharge valve such that a pressure of the low-pressure steam decreases when a pressure of the low-pressure steam is larger than a discharge valve pressure set value;

a bypass configured to introduce steam from the high-pressure header to the low-pressure header by bypassing the turbine;

a bypass valve configured to control steam flow in the bypass;

a bypass valve controller configured to perform a normal control in which an opening of the bypass valve is controlled based on a plant value of a pressure of the low-pressure steam when the turbine is driven; and a trip time control section configured to perform a trip time control in which steam is supplied from the high-pressure header to the low-pressure header by bypassing the turbine in response to a trip signal indicating that the turbine trips, wherein the bypass valve controller performs an after-trip control in which an opening of the bypass valve is controlled to be larger than in the normal control after the trip time control and when the turbine is tripped.

2. The steam system according to claim 1, wherein the bypass valve controller starts the after-trip control when an opening of the discharge valve becomes lower than a predetermined value.

3. The steam system according to claim 1, wherein the bypass valve controller starts the after-trip control when a steam pressure in the low-pressure header decreases more than a predetermined value relative to the discharge valve pressure set value.

4. The steam system according to claim 1, wherein the bypass valve controller comprises a low-pressure side bypass valve controller configured to generate a low-pressure side control value for controlling the bypass valve such that a plant value of a pressure of the low-pressure steam approaches to a low-pressure side pressure set value.

5. The steam system according to claim 4, wherein the low-pressure side bypass valve controller generates the low-pressure side control value based on a difference between a plant value of a pressure of the low-pressure steam and the low-pressure side pressure set value.

6. The steam system according to claim 4, wherein the low-pressure side pressure set value is smaller than the discharge valve pressure set value.

7. The steam system according to claim 4, wherein the bypass valve controller further comprises:

a high-pressure side bypass valve controller configured to generate a high-pressure side control value for controlling the bypass valve such that a pressure of the high-pressure steam approaches to a high-pressure side pressure set value; and a selector configured to select a larger value among the low-pressure side control value and the high-pressure side control value as a control value for controlling an opening of the bypass valve in the normal control.

8. The steam system according to claim 7, further comprising:

a waste-heat boiler configured to supply steam of a first pressure to the high-pressure header; and an auxiliary boiler configured to supply steam of a second pressure smaller than the first pressure, wherein the high-pressure side pressure set value is smaller than the first pressure and larger than the second pressure.

9. The steam system according to claim 4, wherein the bypass valve controller sets the low-pressure side pressure set value to a trip time low-pressure side pressure set value being larger than the low-pressure side pressure set value in the normal control when the after-trip control is started.

10. The steam system according to claim 9, wherein the trip time low-pressure side pressure set value is set to a plant value of the low-pressure steam when the after-trip control is started.

11. The steam system according to claim 10, wherein the trip time low-pressure side pressure set value is set back to the low-pressure side pressure set value in the normal control at a predetermined change rate subsequent to a time when the after-trip control is started.

12. The steam system according to claim 9, wherein the after-trip control is started at timing when a pressure of the low-pressure steam becomes lower than the trip time low-pressure side pressure set value.

13. The steam system according to claim 1, wherein the after-trip control is performed by adding a surplus value gradually increasing to an opening instruction value of the bypass valve in the normal control.

14. A control system for a steam system comprising:

a discharge valve controller configured to control an opening of a discharge valve for discharging low-pressure steam to outside of a low-pressure header such that a pressure of the low-pressure steam stored in the low-pressure header decreases when a pressure of the low-pressure steam is larger than a discharge valve pressure set value;

a bypass valve controller configured to perform a normal control in which an opening of a bypass valve for controlling steam flow in a bypass for introducing steam from a high-pressure header storing a high-pressure steam to the low-pressure header by bypassing a turbine driven by the high-pressure steam supplied from the high-pressure header; and a trip time control section configured to perform a trip time control in which steam is supplied from the high-pressure header to the low-pressure header by bypassing the turbine in response to a trip signal indicating that the turbine trips, wherein the bypass valve controller performs an after-trip control in which an opening of the bypass valve is controlled to be larger than in the normal control after the trip time control and when the turbine is tripped.

15. A control method for a steam system comprising:

controlling an opening of a discharge valve for discharging low-pressure steam to outside of a low-pressure header such that a pressure of the low-pressure steam stored in the low-pressure header decreases when a pressure of the low-pressure steam is larger than a discharge valve pressure set value;

performing a normal control in which an opening of a bypass valve for controlling steam flow in a bypass for introducing steam from a high-pressure header storing a high-pressure steam to the low-pressure header by bypassing a turbine driven by the high-pressure steam supplied from the high-pressure header; and performing a trip time control in which steam is supplied from the high-pressure header to the low-pressure header by bypassing the turbine in response to a trip signal indicating that the turbine trips, wherein the performing a normal control comprises: performing an after-trip control in which an opening of the bypass valve is controlled to be larger than in the normal control after the trip time control and when the turbine is tripped.

* * * * *